US005152685A

United States Patent [19]

Coulon

[11] Patent Number: 5,152,685

[45] Date of Patent: Oct. 6, 1992

[54] LINEAR GAS-BURNER WITH ADJUSTABLE WIDTH

[76] Inventor: Michel Coulon, 111, rue Kléber, F-68800 Thann, France

[21] Appl. No.: 721,463

[22] PCT Filed: Jan. 4, 1990

[86] PCT No.: PCT/FR89/00004

§ 371 Date: Jul. 2, 1991

§ 102(e) Date: Jul. 2, 1991

[87] PCT Pub. No.: WO90/07680

PCT Pub. Date: Jul. 12, 1990

[30] Foreign Application Priority Data

Jan. 6, 1989 [FR] France ..... 89 00240

[51] Int. Cl.[5] ..... F23D 3/40

[52] U.S. Cl. ..... 431/326; 431/355

[58] Field of Search ..... 431/326, 355

[56] References Cited

U.S. PATENT DOCUMENTS 1,497,954 6/1924 Shaw et al. ..... 431/355
1,521,493 12/1924 Whikehart ..... 431/355 X
1,656,549 1/1928 Warmack ..... 431/355 X
1,820,493 8/1931 Reagan ..... 431/355 X

FOREIGN PATENT DOCUMENTS 38512 2/1989 Japan ..... 431/355

*Primary Examiner*—Larry Jones
*Attorney, Agent, or Firm*—Davis, Bujold & Streck

[57] ABSTRACT

This burner comprises a gas distributor (20) with a row of gas injectors (5*a* to 5*e*), the tube being axially inside an air distributor tube. Each gas injector extends through the wall of the air distributor tube via a coaxial air outlet aperture. The gas distributor tube includes two sealing bodies (36, 37) sliding symmetrically on either side of a central gas inlet aperture (21). Each of these bodies is provided with an eccentric longitudinal threaded bore (38, 39) engaging a threaded section of a rotating control rod (41). The two sections (48, 49) are threaded in opposite directions to the thread of the sealing bodies (36, 37), which enables them to move these two sealing bodies simultaneously in order to gradually interrupt or restore the supply of gas to the injectors (5*a* to 5*e*) situated at the end of the row without interrupting the supply to the air injectors.

8 Claims, 2 Drawing Sheets

31
30
28
29
27
12
45
35
17
16
11
7
9
6
5
8
10
4
3
2
1
34
20
24
26
26a
25
A
II
II
G
21
22

41
16
12
6
5
11
1
2

LINEAR GAS-BURNER WITH ADJUSTABLE WIDTH

The present invention concerns a linear gas and blown air burner, comprising an air distributor tube connected to a pressurized air supply, a gas distributor tube fitted inside the air distributor tube and equipped with a gas inlet connected to a pressurized gas supply, and at least one longitudinal row of gas injectors, these injectors extending virtually radially from the gas distributor tube through air injectors fitted on air outlet apertures made in the wall of the air distributor tube, each gas injector being fitted on a gas outlet aperture made in the wall of the gas distributor tube.

BACKGROUND OF THE INVENTION

Such a linear gas burner, described in the European patent No. 0190091, offers great advantages from a security point of view, as the mixing of the gas with the blown air occurs only at the inlet of the combustion zone, and from a convenience point of view as it has a very high ratio between its maximum power and its minimum power. This is why it is very widely used, notably in the food industry and in the textile industry. This is the case in particular with textile finishing machines, especially drying and heatsetting tenters where it permits both an optimal distribution of the heat over the whole surface of the product to be treated and a modulation of power of up to 1:50 which, in uses as different as the drying of the fabrics or the heatsetting of the dyes, permits treatment at very precise temperatures whatever the heat requirement. In this perspective, such linear gas burners are starting to be used in place of steam, of electricity or of thermofluid heating, to inwardly heat drying drums formed by a rotating metallic casing over which passes a band of a product to be dried such as a fabric, a sheet of paper, etc. Firstly, gas is, at present, a cheap form of energy, which can be used with a very high output and secondly, it enables higher temperatures to be obtained than with steam heating, which is necessary in certain heat treatments. Moreover, more precise and more evenly distributed temperatures are obtained, notably compared with thermofluid or electric heating. Finally, a gas-burner is a heating device which can be used independantly without being linked to other installations, and in particular to a boiler room. Moreover, compared with other types of linear gas-burners such as pre-mixing burners, the use of a burner of the type indicated above is particularly worthwhile due to its great possibility of power modulation, which allows a very precise adjustment.

However, the need exists to be able to adjust in quite a precise way, the width of the zone to be heated. For example, in a fabric drying drum, trials have shown that the evenness of the drying is closely linked to the active width of the gas-burner. If the fabric is of a greater width than the burner, its selvages will be insufficiently dried. If the burner has an active width greater than that of the fabric, the latter will be excessively dried near its selvages. Indeed, the zones at the extremities of the drum, which are not covered by the fabric but are nonetheless heated by the burner, can reach an excessive temperature of up to around 400° C. which is detrimental both for the drum and the fabric. If burners which pre-mix the gas and the combustion air are used, it is not too difficult to conceive a mechanism which reduces the active length of the burner, by progressively sealing the gas outlet apertures. Publication GB-A-204 756 shows a linear pre-mixed gas burner which has a distributor tube supplied half way along its length and sealed by two pistons fitted on an axial shaft threaded in two opposite directions. However, this type of pre-mixing burner belongs to a technology which is fundamentally different from that of pure gas burners and has other drawbacks mentioned above. In a pure gas and blown air burner of this type, one solution could consist in dividing the burner up into several linear or punctual burners, with outside valves on the corresponding gas supplies. However, such a solution is complicated, bulky and costly, and it only allows a relatively rough adjustment thread.

SUMMARY OF THE INVENTION

The present invention thus aims at providing a linear gas-burner of the type indicated in the preamble, equipped with a device enabling the active width of the flame to be precisely adjusted, by maintaining either engaged or not, individually, at least the injectors situated near an extremity of the row.

With this aim, the burner according to the invention is characterized in that the gas distributor tube is inwardly sealed by at least one sliding sealing body fitted so as to block the gas supply of a section of this tube comprising one or several gas injectors, the said sealing body being coupled with a control rod set out longitudinally in this tube and linked to means of control situated outside this tube, and in that all the air injectors of the said row continue to be supplied with air when the gas supply of one or several gas injectors is blocked by the said sealing body.

In a preferred embodiment, the control rod is rotary around its axle and comprises at least one threaded section which is fitted into a corresponding threaded bore of the sealing body, and the sealing body is equipped with means which prevent it from turning in the gas distributor tube. The control rod can be fitted in a rotary way in two elements closing the extremities of the gas distributor tube, the rod going through at least one of the elements to be linked to the means of control.

Preferably, the gas distributor tube has a circular cross section, as has the sealing body, and to prevent the sealing body from turning in the tube, the control rod and the threaded bore of this body are set out along an axle which is off centre in relation to the axle of the tube.

In a particularly advantageous embodiment, the gas distributor tube is equipped with two sliding sealing bodies and with a lateral gas inlet situated between these two bodies. Preferably, the control rod comprises two elements threaded in opposite directions and fitted respectively into the two sealing bodies, so as to make these two bodies slide simultaneously in opposite directions. The control rod can be connected to the means of control by a coupling which can be disconnected.

BRIEF DESCRIPTION THE DRAWINGS

The present invention can be better understood with the help of the following description of an example of embodiment, with reference to the annexed drawings in which.

DESCRIPTION OF THE PREFERRED EMBODIMENT

Figures 1, 2:
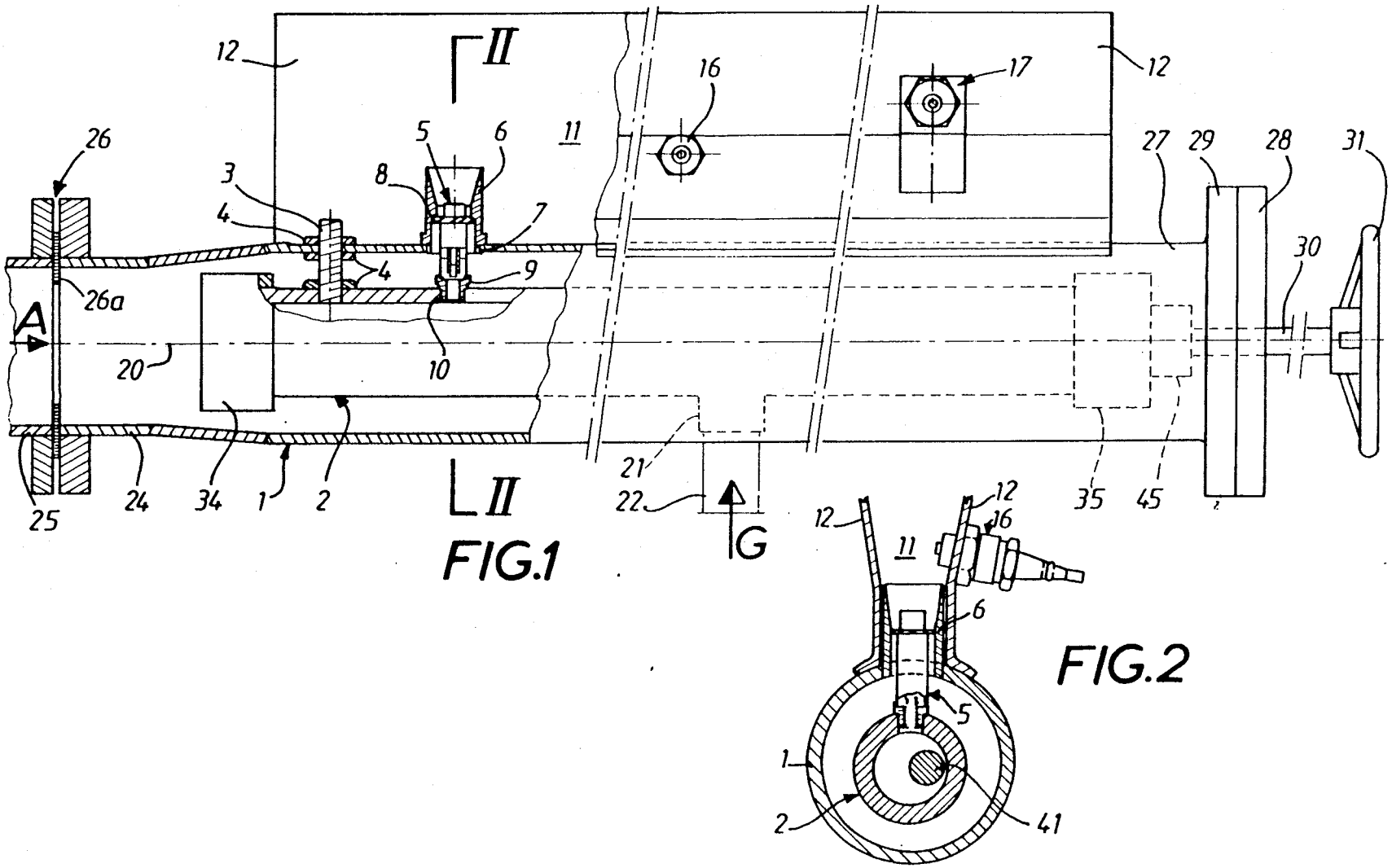
FIG. 1 is a schematic lateral elevation view, partly cut, of an embodiment of a gas-burner according to the invention.
FIG. 2 is a schematic cross section view of this burner, along line II—II of FIG. 1.

With reference to the figures, the linear burner shown comprises an outside air distributor tube 1, a gas distributor tube 2 fitted inside tube 1 in an adjustable position thanks to a pair of threaded rods 3 screwed into the wall of tube 2 and equipped with locknuts 4, and a row of gas injectors 5 fixed onto tube 2 at right angles to the latter and extending towards the outside, each one through an air injector 6 formed by a tubular opening fixed in an aperture 7 of tube 1. Each air injector contains a turbulence ring 8, which favours the mixing of the gas and the combustion air at the outlet of gas injector 5. This type of injector is well known and it is described in more detail in EP-A-0 190 091. In the present case, each gas injector 5 is equipped with a threaded collar 9 which is screwed into a tapped bore 10 of the gas distributor tube 2.

Injectors 5 and 6 are set out in a row and all emerge into a combustion zone 11 defined by a flame guide 12 in refractory steel, which is fixed on the outside of tube 1 by bolting in slides (not shown), these same being bolted onto tube 1. The flame guide 12 carries an electric igniter 16 and a flame control device 17, for example by detection of ultraviolet radiation. The above-mentioned arrangements are well known in the field of gas and blown air burners.

In this preferred embodiment example, the gas distributor tube 2 is a cylindrical, rectilinear tube, with a longitudinal axis 20 set out approximately but not necessarily in the centre of tube 1. In the middle of its length, tube 2 is equipped with a lateral gas inlet nozzle 21 connected to a supply pipe 22 which goes through the wall of tube 1 and which supplies the burner with gas coming, as indicated by arrow G, from an adjustment valve which is not shown. This valve permits the gas flow, and thus the power of the burner, to be adjusted. The gas can be, for example, natural gas, liquified petroleum gas or a manufactured gas such as town gas or blast furnace gas. By the inside of tube 2, it reaches the different injectors 5 fitted in the apertures 10.

One extremity 24 of the air distributor tube 1 is connected to an air supply pipe 25, by an assembly of flanges 26 equipped with a diaphragm **26*a* controlling the flow of air, which is blown at a low pressure and arrives as indicated by arrow A, then goes around the gas distributor tube 2 to reach the air injectors 6 which mix it with the gas at the inlet of the combustion zone 11. The other extremity 27 of tube 1 is sealed by a cover 28 fixed onto a flange 29 of the tube and through which runs a control shaft 30 equipped with a manual wheel 31** or with an automatic control.

Figure 3:
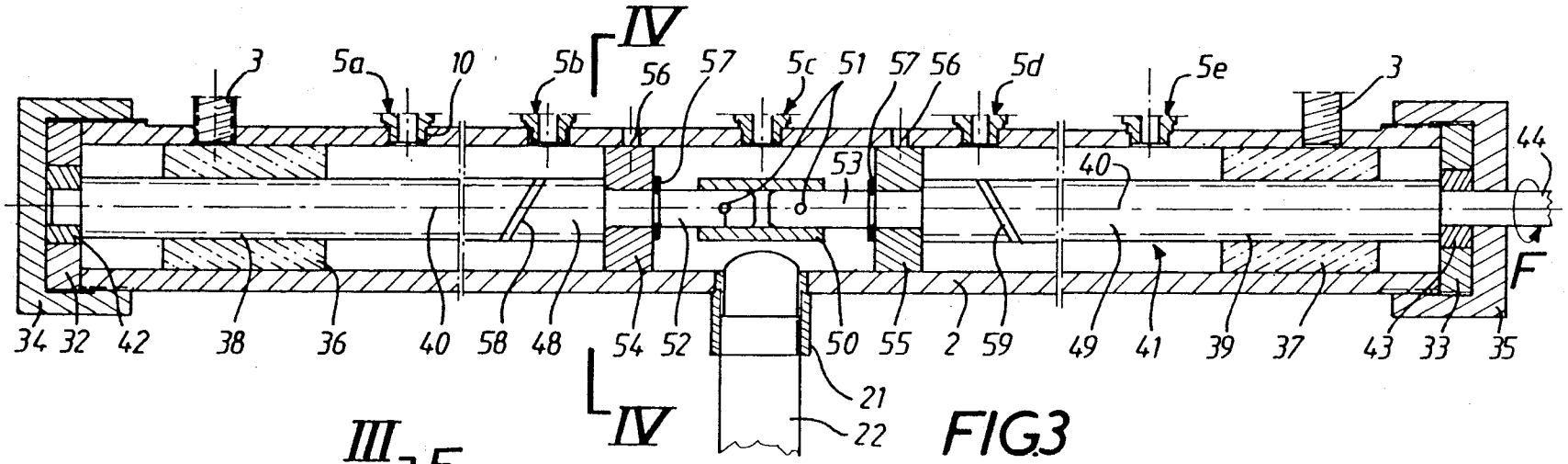
FIG. 3 is a longitudinal section view, along line III—III of FIG. 4, of the gas distributor tube of this burner and of the adjustment mechanism it contains.
Figure 4:
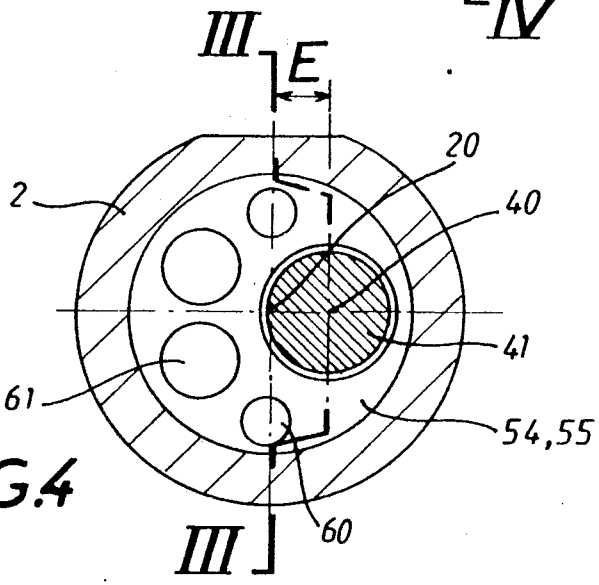
FIG. 4 is a cross section view along line IV—IV of FIG. 3.

The gas distributor tube 2 is shown in more detail in FIGS. 3 and 4. It is a cylindrical rectilinear tube made of steel, supported by the threaded rods 3 and holding the gas injectors 5. In order to simplify, only five gas injectors **5*a* to 5*e* have been shown. Each end of tube 2 is closed by a plate 32, 33 fixed by a threaded cap 34, screwed onto the outside of tube 2**.

Two sealing nuts 36, 37 are fitted in a sliding way in the inside bore of tube 2 and each of them closes this bore in an airtight way between the corresponding extremity of the tube and the gas inlet nozzle 21. Each of these nuts can be formed for example by a bronze cylindrical part pierced with an eccentric longitudinal bore equipped with a threading 38, 39 and centred on an axis 40 which is removed by a distance E compared with axis 20 of tube 2 and of the outside surface of the nut. In this example, this gap E is lateral, but it could be foreseen in another direction. A rotary rod 41, * extends longitudinally in tube 2 and is held by stuffing-box bearings 42, 43 fitted in plates 32 and 33. One extremity 44 of the rod 41 goes through the cap 35 and is connected to the control shaft 30 by means of an appropriate coupling 45 (FIG. 1), for example a fork coupling. Inside tube 2, the rotary rod 41 is subdivided into two symmetrical elements 48 and 49 made integral in rotation by a coupling-box 50 and elastic pins 51, approximately in the middle of the length of tube 2. In this zone, each element 48,49 has a cylindrical section 52, 53 supported in a rotary way by a respective brace 54, 55 fixed in tube 2 by screws 56. On the side of the middle of the tube, the element 48,49 is held longitudinally by an elastic ring of the "circlips" type 57. On the other side of the brace, it is of greater diameter and is equipped with a threading 58, 59 fitted into the threading 38, 39 of the corresponding nut 36, 37. The threadings 39 and 59 are in the normal direction, whereas the threadings 38 and 58 are in the opposite direction. Each brace 54, 55 is pierced with several holes 60, 61 to allow the gas to go along tube 2.

* also centred on axle 40

Thus, when the control wheel 31 is turned so as to turn the rod 41 in the direction of arrow F, i.e. in an anticlockwise direction, the two nuts 36 and 37 cannot turn due to the fact that the rod 41 is maintained by its bearings in an eccentric position, and slide in the tube, moving symmetrically closer to one another, whereas they move away from each other if the rod 41 is turned in the opposite direction. In moving closer together, the nuts 36 and 37 will seal the apertures 10 in which are fitted the two injectors **5*a* and 5*e* situated at the extremity of the row. The linear flame of the burner will be shortened symmetrically by a short distance at its two extremities, each time the nuts 36, 37 block the supply of a further pair of injectors 5. In the same way, the flame will become wider if the wheel 31 and the rod 41 are turned in the opposite way. Of course, the adjustment of the gas supply flow at the same time can be foreseen. This adjustment can be carried out automatically with a pressure captor on the supply pipe 22. In another embodiment, it can be linked to a motorized control of the flame width adjustment mechanism, activating the rotary rod 41. Meanwhile, the air continues to be delivered into the combustion zone 11 by all the injectors 6, even where the injectors 5** no longer receive any gas. In a drying drum as mentioned above, this has the advantage of helping to cool the zones at the extremities of the drum.

Figure 5:
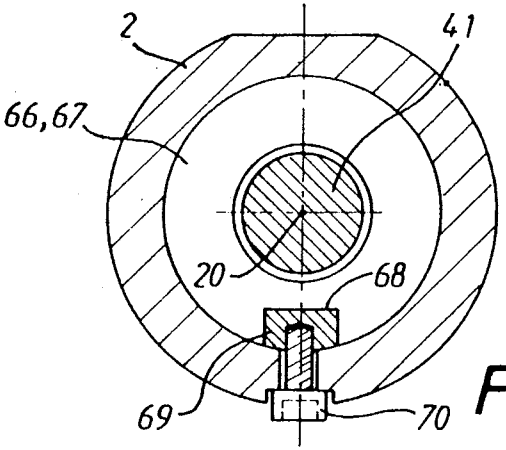
FIG. 5 is an analogous view to FIG. 4 and shows another embodiment.

The present invention is not limited to the embodiment described above as an example, but can be extended to all modifications or variants obvious for an expert. In particular, the eccentric layout of rod 41 is not indispensable, as shown by FIG. 5. In this variant, the nuts 36, 37 are replaced by nuts 66, 67 which have a threaded bore centred on the axle 20 of tube 2. In order to be prevented from turning, each nut is equipped with a lateral groove 68, which slides on a corresponding longitudinal key 69, fixed in tube 2 by screws 70 and extending over the whole length of the stroke of the nut. This layout means that one can do without the braces 54, 55 of the previous example and use a rod 41 in one single piece. However, the eccentric layout has the advantage of facilitating the airtightness and the manufacturing. In another variant, each nut 36, 37 or 66, 67 could be conceived in two elements, one of which ensures the airtightness and the other serves as a nut proper on the threading of rod 41.

It must also be noted that the sealing bodies constituted by the nuts 36, 37 could be replaced by bodies controlled in a different way, for example by means of sliding rods controlled from the outside of the burner by a linear activator.

I claim:

1. A linear gas and air burner comprising an air distributor tube (1) connected to a pressurized air supply (A), a gas distributor tube (2) located inside the air distributor tube and equipped with a gas inlet (21) connected to a pressurized gas supply (G), and at least one longitudinal row of gas injectors (5) extending radially from the gas distributor tube through air injectors (6) connected with air outlet apertures made in the wall of the air distributor tube, each gas injector (5) being connected to a gas outlet aperture (10) made in the wall of the gas distributor tube, wherein the gas distributor tube (2) is inwardly sealed by at least one sliding sealing body (36, 37, 66, 67) positionable so as to block the supply of gas to a desired section of the gas distributor tube, the at least one sliding sealing body is coupled with a control rod (41) extending longitudinally within the gas distributor tube and linked to control means (30, 31), for controlling the position of the at least one sliding sealing body, situated outside of the gas distributor tube, and all the air injectors (6) are continuously supplied with air even when the supply of gas to at least one of the gas injectors (5) is blocked by the at least one sliding sealing body.

2. A burner according to claim 1, wherein the control rod (41) is rotatable about an axis (40) and comprises at least one threaded section (58, 59) which engages a corresponding threaded bore (38, 39) of the at least one sliding sealing body (36, 37, 66, 67), and the at least one sliding sealing body is equipped with means (68, 69) for preventing the at least one sliding sealing body from rotating within the gas distributor tube.

3. A burner according to claim 2, wherein the control rod (41) is rotatably supported by two elements (32, 33) sealing extremities of the gas distributor tube (2), and the control rod extends through at least one of two elements and is linked to the control means (30, 31).

4. A burner according to claim 2, wherein the gas distributor tube (2) and the at least one sliding sealing body (36, 37) have a circular cross section, and to prevent the at least one sliding sealing body from turning in the tube, the control rod (41) and the threaded bore (38, 39) extend along an axis (40) which is off center relative to a central axis (20) of the tube.

5. A burner according to claim 2, wherein the control rod (41) comprises two elements (48, 49) threaded in opposite directions and each of the two elements (48, 49) respectively engage one of the two sliding sealing bodies (36, 37) so as to make the two sliding sealing bodies slide simultaneously in opposite directions.

6. A burner according to claim 2, wherein the control rod (41) is connected to the control means (30, 31) by a coupling (45) which is disconnectable.

7. A burner according to claim 1, wherein the gas distributor tube (2) is equipped with two sliding sealing bodies (36, 37, 66, 67) and a lateral gas inlet (21) is situated between the two sliding bodies.

8. A burner according to claim 7, wherein the control rod (41) comprises two elements (48, 49) threaded in opposite directions and each of the two elements (48, 49) respectively engage one of the two sliding sealing bodies (36, 37) so as to make the two sliding sealing bodies slide simultaneously in opposite directions.

* * * * *